US005720702A

United States Patent [19]

Lee

[11] Patent Number: 5,720,702

[45] Date of Patent: Feb. 24, 1998

[54] RESILIENT EXERCISE DEVICE

[76] Inventor: Sunny Lee, No. 257-8, Chung-Cheng Rd., Tsao-Tun Chen, Nan-Tou Hsien, Taiwan

[21] Appl. No.: 722,500

[22] Filed: Sep. 27, 1996

[51] Int. Cl.[6] ..... A63B 21/02

[52] U.S. Cl. ..... 482/129; 482/123; 482/904

[58] Field of Search ..... 482/121, 122, 482/123, 129, 904

[56] References Cited

U.S. PATENT DOCUMENTS

| | | | |
|---|---|---|---|
| 3,662,602 | 5/1972 | Weiss | 482/123 |
| 5,074,551 | 12/1991 | Olschansky et al. | 482/130 |
| 5,407,414 | 4/1995 | Bass | 482/904 |
| 5,456,644 | 10/1995 | Hecox et al. | 482/130 |
| 5,505,681 | 4/1996 | Bruggemann | 482/904 |
| 5,536,228 | 7/1996 | Tanner, Jr. | 482/123 |

*Primary Examiner*—Lynne A. Reichard
*Attorney, Agent, or Firm*—Renner, Otto, Boisselle & Sklar, P.L.L.

[57] ABSTRACT

An exerciser includes a base frame, a rotary plate, a driven rod and an elastic cord. The base frame has an upright rod, a transverse rod and two U-shaped clamping members. A plurality of adjusting pulleys are mounted to the upright rod. Each of the end portions and the intermediate portion of the transverse rod has a pulley. The rotary plate has a circular portion and an eccentric portion. The circular portion is mounted rotatably to a pivot shaft of the upright rod and has a plurality of positioning holes. The eccentric portion has left and right pulleys rotatably mounted to its rear side face. The driven rod has an upper end connected rotatably to the pivot shaft, a positioning pin extending slidably through the driven rod and extendible into one of the positioning holes in order to position the driven rod relative to the rotary plate at a selected angle, and a transverse bar connected to a lower end of the driven rod. The elastic cord has two ends which are connected respectively to the end portions of the transverse rod. The elastic cord passes over the right pulley of the rotary plate, under the pulleys of the transverse rod and over the left pulley of the rotary plate under tension.

4 Claims, 10 Drawing Sheets

RESILIENT EXERCISE DEVICE

BACKGROUND OF THE INVENTION

1. Field of the Invention

This invention relates to an exerciser, more particularly to an exerciser which can be operated in different exercising modes.

2. Description of the Related Art

Presently, there are many kinds of exercisers that are available in the market. When purchasing an exerciser, the consumer usually considers the functions offered by the exerciser in addition to its price and quality. However, most exercisers are usually operable in only one exercising mode, thereby resulting in a need for the consumer to buy additional exercisers so as to perform a larger number of exercises.

SUMMARY OF THE INVENTION

Therefore, the object of the present invention is to provide an exerciser which can be operated in more than one exercising mode.

According to the present invention, an exerciser comprises:

a base frame including an upright rod which has upper and lower ends and an intermediate portion, a transverse rod which has two end portions and an intermediate portion which is connected to the lower end of the upright rod, two U-shaped clamping members which are fastened respectively to the upper and lower ends of the upright rod, a handle bar which is connected transversely adjacent to the upper end of the upright rod, a pivot shaft which extends perpendicularly from the intermediate portion of the upright rod, and a plurality of adjusting pulleys which are mounted rotatably and lengthwise adjacent to the lower end of the upright rod, each of the end portions and the intermediate portion of the transverse rod having a pulley connected rotatably thereto;

a rotary plate having a circular portion with a central hole and an eccentric portion which extends radially from a periphery of the circular portion, the pivot shaft passing through the central hole of the rotary plate so that the rotary plate can rotate about the pivot shaft, the circular portion having a plurality of positioning holes spaced angularly near the periphery of the circular portion, the eccentric portion having a rear side face and left and right pulleys mounted rotatably to the rear side face of the eccentric portion;

a driven rod having an upper end which is connected rotatably to the pivot shaft, a positioning pin which extends slidably through the driven rod and which is extendible into one of the positioning holes in order to position the driven rod relative to the rotary plate at a selected angle, a lower end, a receiving bore which extends longitudinally from the lower end of the driven rod, an elongated groove which is formed in the driven rod and which is communicated with the receiving bore, an adjusting rod which is received slidably in the receiving bore and which has a lower end that extends out of the receiving bore, and a locking screw which passes through the elongated groove and which engages threadedly the adjusting rod in order to lock the adjusting rod relative to the driven rod and adjust a total length of the driven rod and the adjusting rod, the lower end of the adjusting rod having a transverse bar which is connected perpendicularly thereto; and an elastic cord having two ends which are connected respectively to the end portions of the transverse rod, the elastic cord passing over the right pulley of the rotary plate, passing under the pulleys of the transverse rod and passing over the left pulley of the rotary plate under tension.

A resistive force is exerted onto the rotary plate by the elastic cord when the rotary plate is rotated about the pivot shaft.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
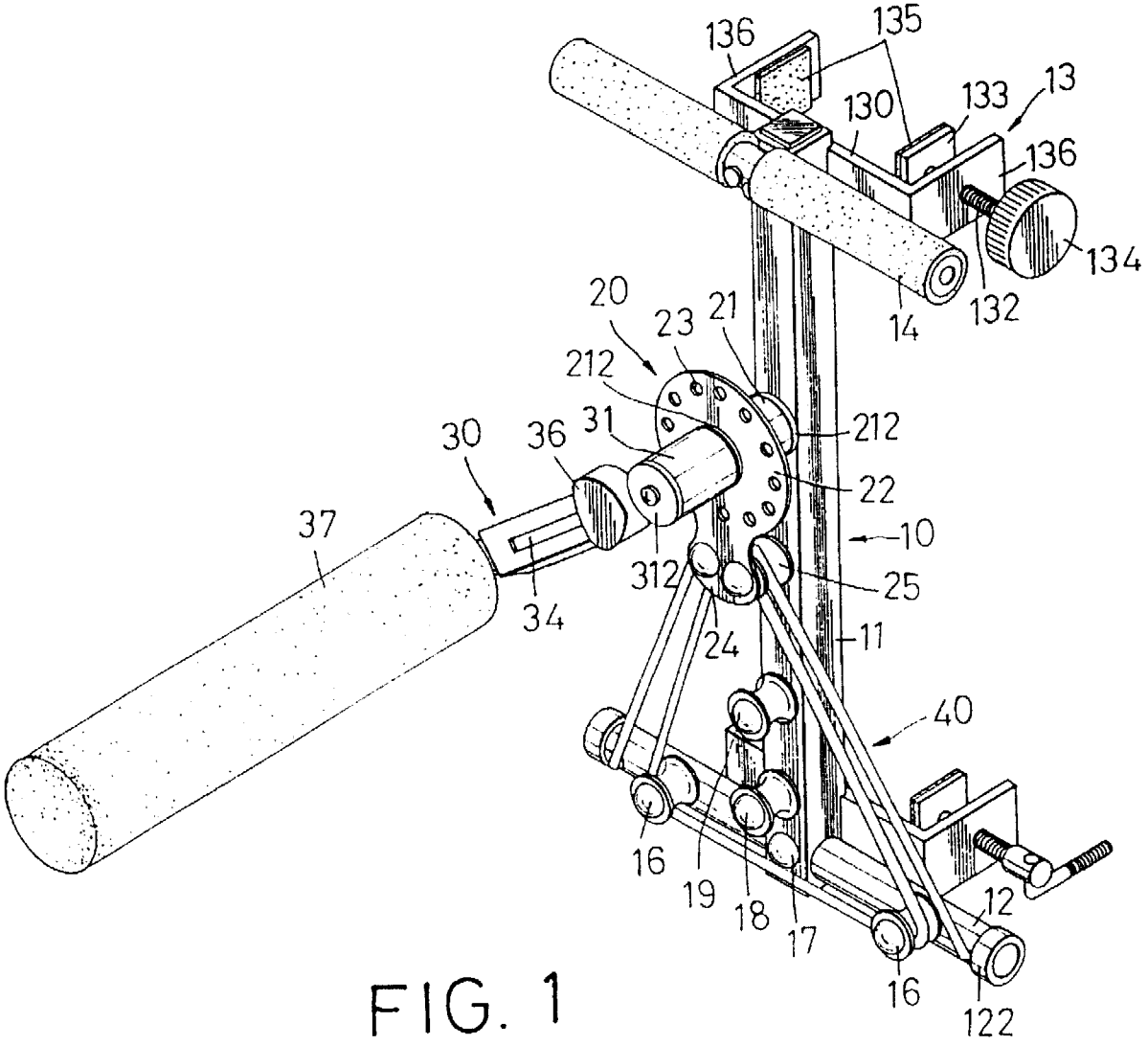
FIG. 1 is a perspective view of a preferred embodiment of an exerciser according to the present invention.
Figure 2:
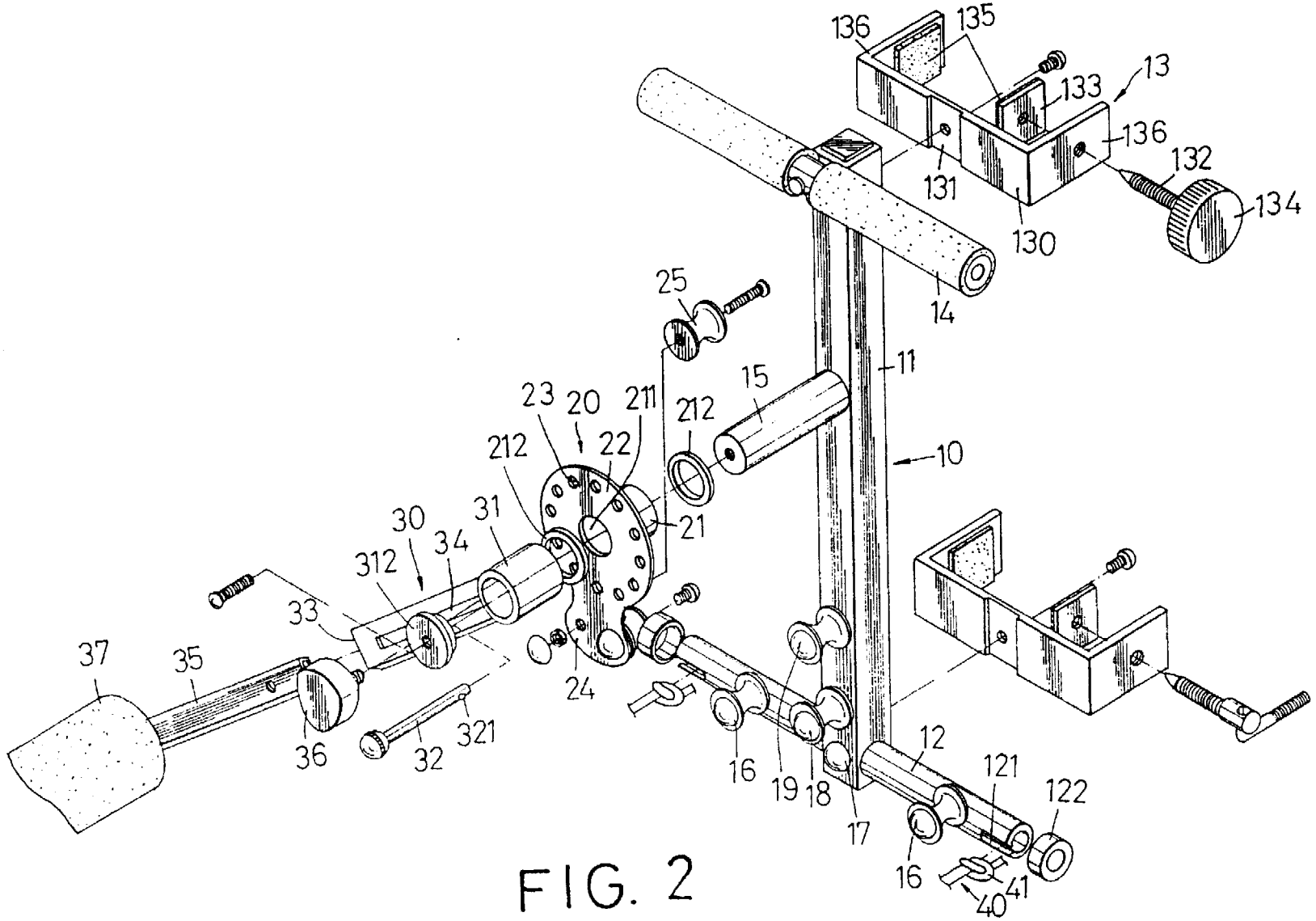
FIG. 2 is an exploded view of the preferred embodiment of the exerciser according to the present invention.

Referring to FIGS. 1 and 2, a preferred embodiment of an exerciser according to the present invention is shown to comprise a base frame 10, a rotary plate 20, a driven rod 30 and an elastic cord 40.

Figure 3:
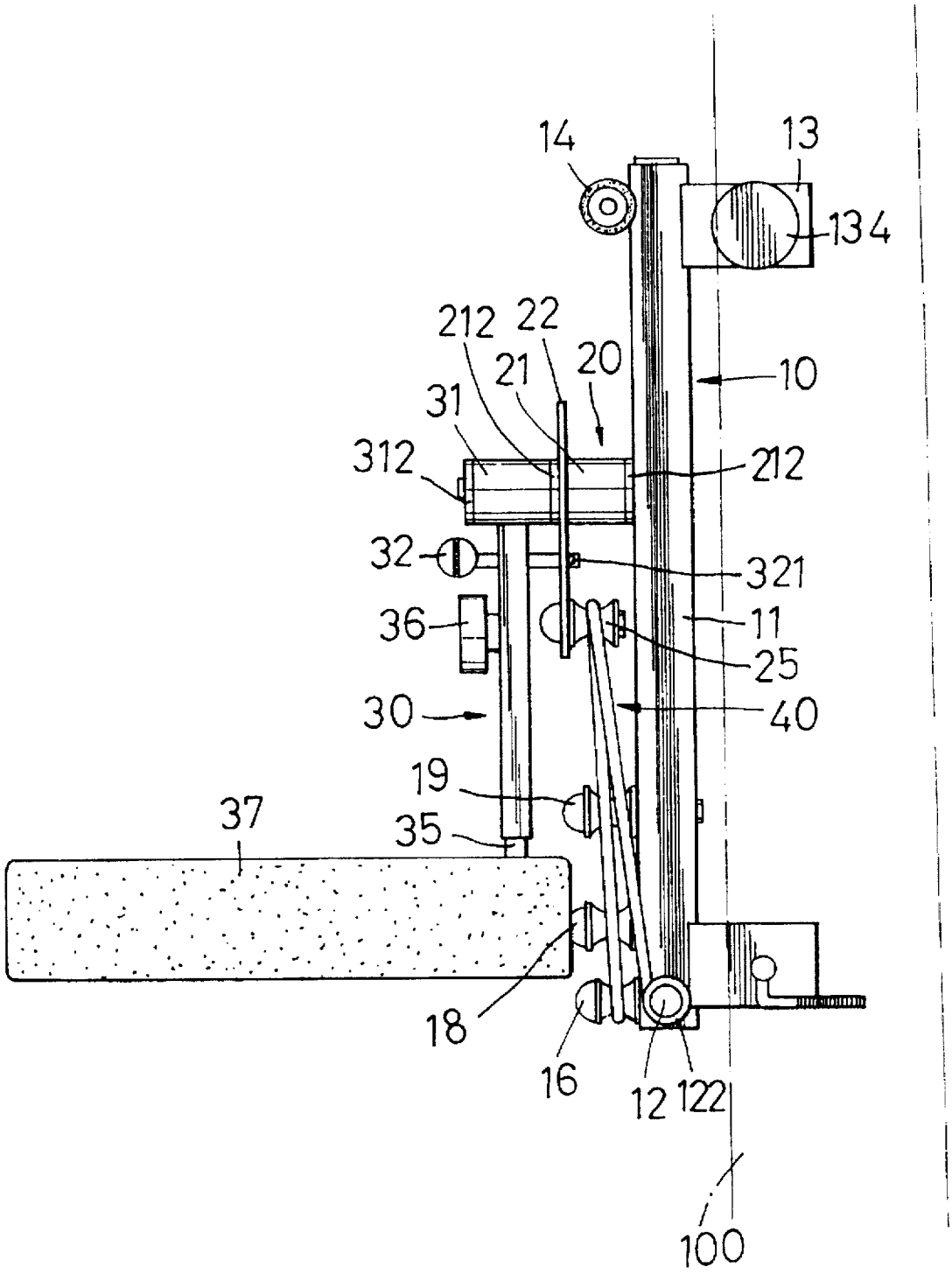
FIG. 3 is a side view of the preferred embodiment of the exerciser according to the present invention.

The base frame 10 includes an upright rod 11 and a transverse rod 12. The intermediate portion of the transverse rod 12 is connected to the lower end of the upright rod 11. Each end portion of the transverse rod 12 is hollow and has a longitudinal notch 121 and a cap member 122 attached thereto. Two U-shaped clamping members 13 are fastened respectively to the upper and lower ends of the upright rod 11. Each of the U-shaped clamping members 13 has a base portion 130 and a recess 131 which is formed in the external face of the base portion 130 and which engages fittingly the upright rod 11. Each of the U-shaped clamping members 13 further has an adjusting knob 134 with a threaded rod 132 which extends through one of the arm portions 136, a rectangular plate 133 connected to the free end of the threaded rod 136, and two pads 135 adhered respectively to the rectangular plate 135 and the other one of the arm portions 136. Therefore, the U-shaped clamping members 13 can be clamped to a wall stud 100 by rotating the adjusting knob 134, as best illustrated in FIG. 3.

With reference to FIGS. 1 and 2, a handle bar 14 is connected transversely adjacent to the upper end of the upright rod 11. A pivot shaft extends perpendicularly from the intermediate portion of the upright rod 11. Upper and lower adjusting pulleys 19, 18 are mounted rotatably and lengthwise adjacent to the lower end of the upright rod 11. A semi-circular stud 17 projects from the upright rod 11 below the lower adjusting pulley 18. Each of the end portions of the transverse rod 12 has a pulley 16 connected rotatably thereto.

The rotary plate 20 has a circular portion 22 with a central hole 211, a tubular member 21 coaxially connected to the central hole 211 of the circular portion 22, and an eccentric portion 24 which extends radially from a periphery of the circular portion 22. The pivot shaft 15 passes through the tubular member 21 and the central hole 211 so that the rotary plate 20 can rotate about the pivot shaft 15. A pair of bushings 212 are mounted to either side of the rotary plate 20 near the front and rear ends of the tubular member 21 in order to facilitate the rotation of the rotary plate 20 on the pivot shaft 15. The circular portion 22 has a plurality of positioning holes 23 spaced angularly near the periphery of the circular portion 22. The eccentric portion 24 has left and right pulleys 25 mounted rotatably to the rear side face of the eccentric portion 24.

Figure 4:
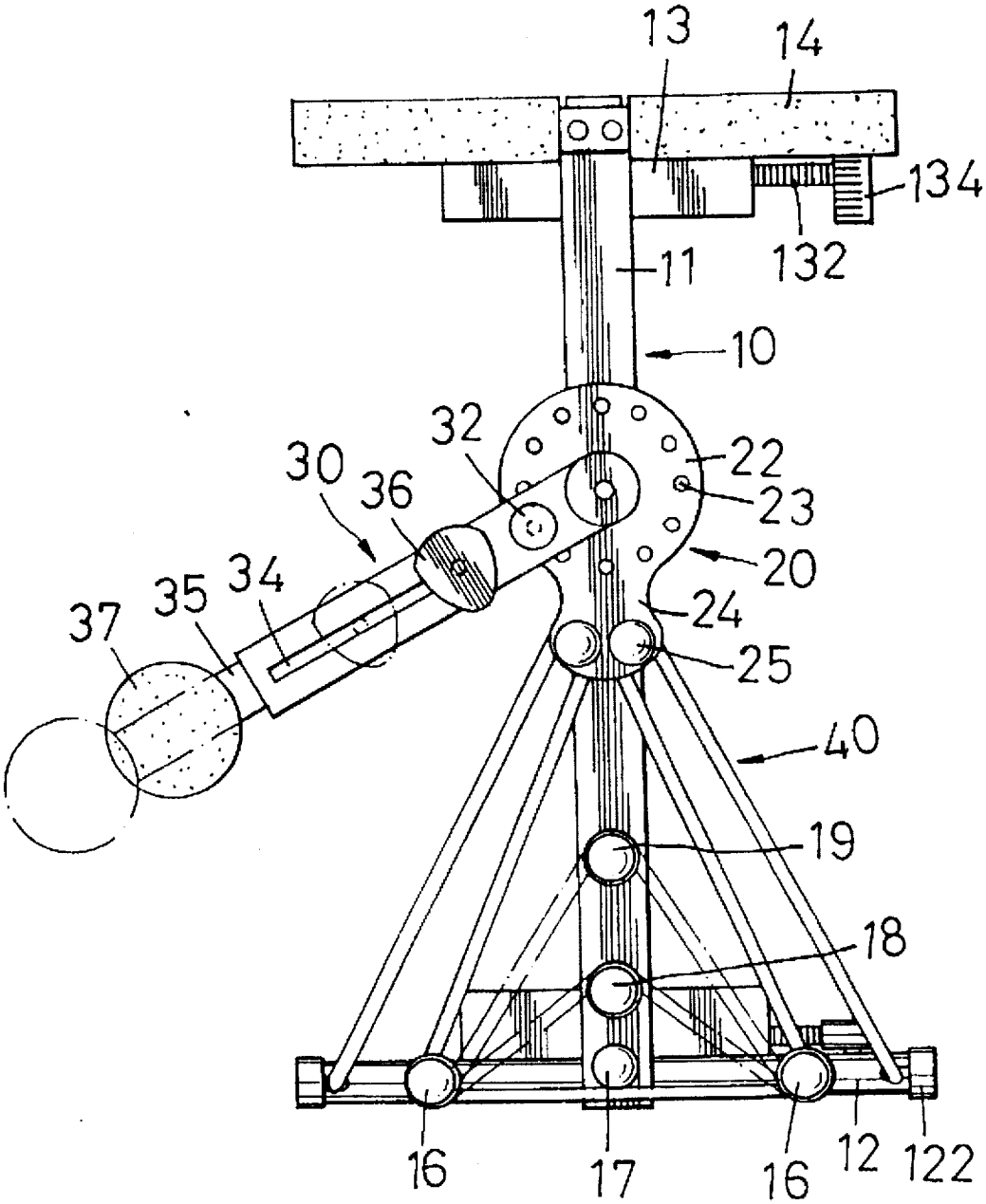
FIG. 4 is a front schematic view illustrating how the total length of an adjusting rod and a driven rod of the exerciser is adjusted according to the present invention.
Figure 5:
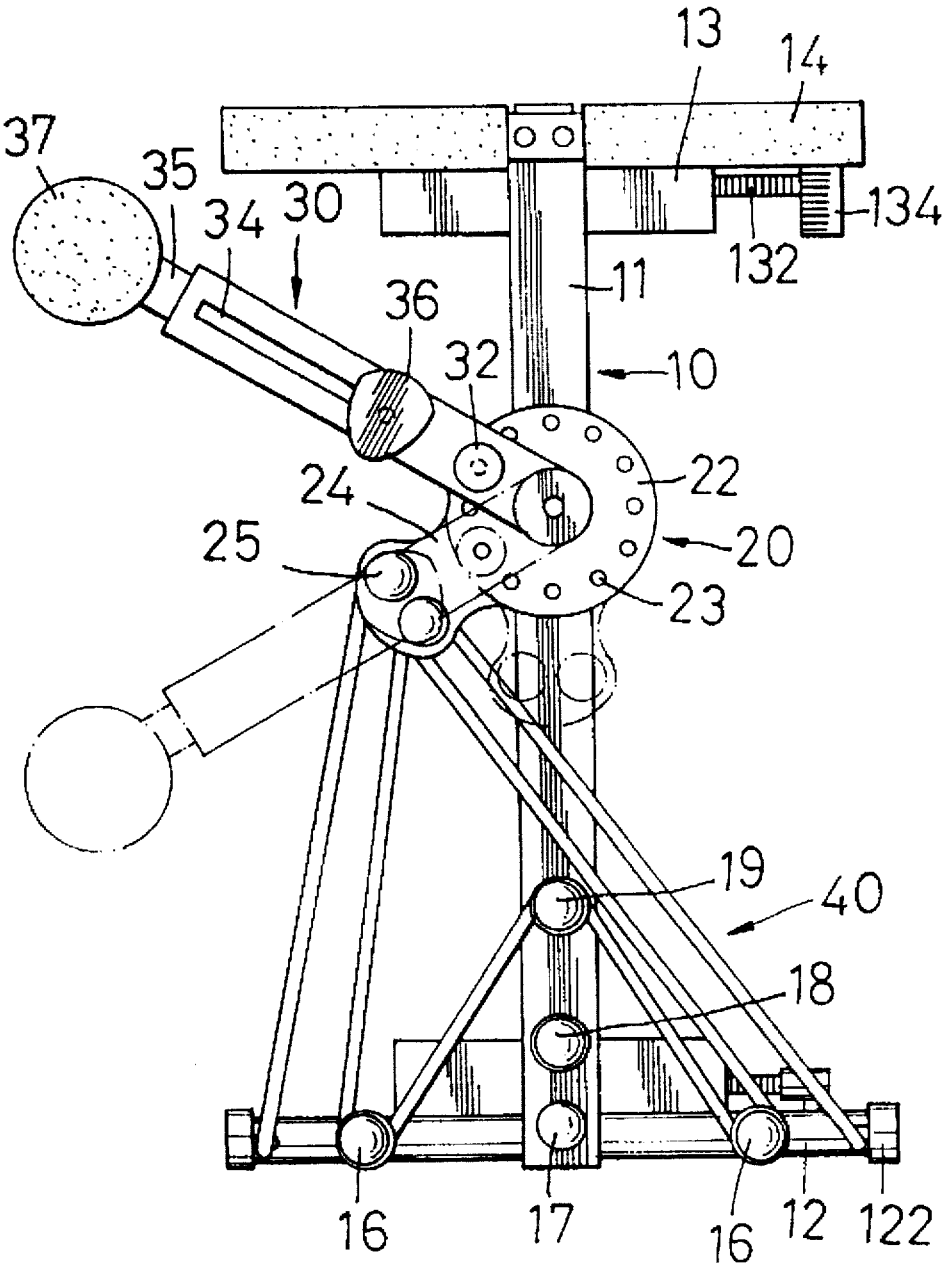
FIG. 5 is a front schematic view illustrating how the driven rod is positioned relative to a rotary plate of the exerciser at a selected angle and how the tension of the elastic cord is adjusted by rotating the rotary plate in accordance with the present invention.

The driven rod 30 has a sleeve 31 at an upper end thereof. The sleeve 31 is fitted rotatably to the pivot shaft 15. The front end of the sleeve 31 has a plug member 312 which is fastened to the free end of the pivot shaft 15 in order to prevent the disengagement of the sleeve 31 from the pivot shaft 15. A positioning pin 32 extends slidably through the driven rod 30 and is extendible into one of the positioning holes 23 in order to position the driven rod 30 relative to the rotary plate 20 at a selected angle, as best illustrated in FIGS. 2 and 5. Once the positioning pin 32 is inserted into one of the positioning holes 23, the driven rod 30 can be rotated with the rotary plate 20. The positioning pin 32 has a spring-loaded steel ball 321 mounted near the inserting end thereof in order to releasably retain the positioning pin 32 in one of the positioning holes 23, as shown in FIG. 2. The driven rod 30 further has a receiving bore 33 which extends longitudinally from the lower end thereof, and an elongated groove 34 which is communicated with the receiving bore 33. An adjusting rod 35 is received slidably in the receiving bore 33 with its lower end extending out of the receiving bore 33. A locking screw 36 passes through the elongated groove 34 and engages threadedly the adjusting rod 35 in order to lock the adjusting rod 35 relative to the driven rod 30 and adjust a total length of the driven rod 30 and the adjusting rod 35, as best illustrated in FIG. 4. The lower end of the adjusting rod 35 has a transverse bar 37 which is connected perpendicularly thereto.

Two ends of the elastic cord 40 are connected respectively to the end portions of the transverse rod 12. More specifically, each end of the elastic cord 40 has a knot 41 which engages a respective one of the notches 121 of the transverse rod 12. The cap members 122 prevent the ends of the elastic cord 40 from disengaging the transverse rod 12. The elastic cord 40 passes over the right pulley 25 of the rotary plate 20, under the pulleys 16 of the transverse rod 25 and over the left pulley 25 of the rotary plate 20 under tension in order to form a generally triangular loop. Thus, a resistive force can be exerted onto the rotary plate 20 by the elastic cord 40 when the rotary plate 20 is rotated about the pivot shaft 15.

The operations and effects of the preferred embodiment of the exerciser according to the invention are as follows:

Referring to FIGS. 3 and 4, when the exerciser is to be used, the U-shaped clamp members 13 are clamped onto the wall stud 100 by rotating the adjusting knob 134. The total length of the driven rod 30 and the adjusting rod 35 is then adjusted by moving the adjusting rod 35 relative to the driven rod 30 and positioning the adjusting rod 35 relative to the driven rod 30 by means of the locking screw 36.

Referring to FIG. 5, the driven rod 30 can be rotated freely relative to the rotary plate 20 after the positioning pin 32 is disengaged from the rotary plate 20 and can be positioned at a given angle relative to the rotary plate 20 by inserting the positioning pin 32 in one of the positioning holes 23. When the user exerts a force on the transverse bar 37, the driven rod 30 and the rotary plate 20 will be rotated. Therefore, the elastic cord 40 which is trained on the pulleys 25 of the rotary plate 20 will be pulled upwardly against the rotation of the rotary plate 20 and the driven rod 30. Thus, a resistive force is exerted on the user. The resistant force, i.e. the tension of the cord 40, may be varied by engaging the elastic cord 40 with one of the stud 17 and the lower and upper adjusting pulleys 18, 19. The tension of the elastic cord 40 is largest when the cord 40 engages the upper adjusting pulley 19 and is smallest when the cord 40 engages the stud 17.

Figure 6:
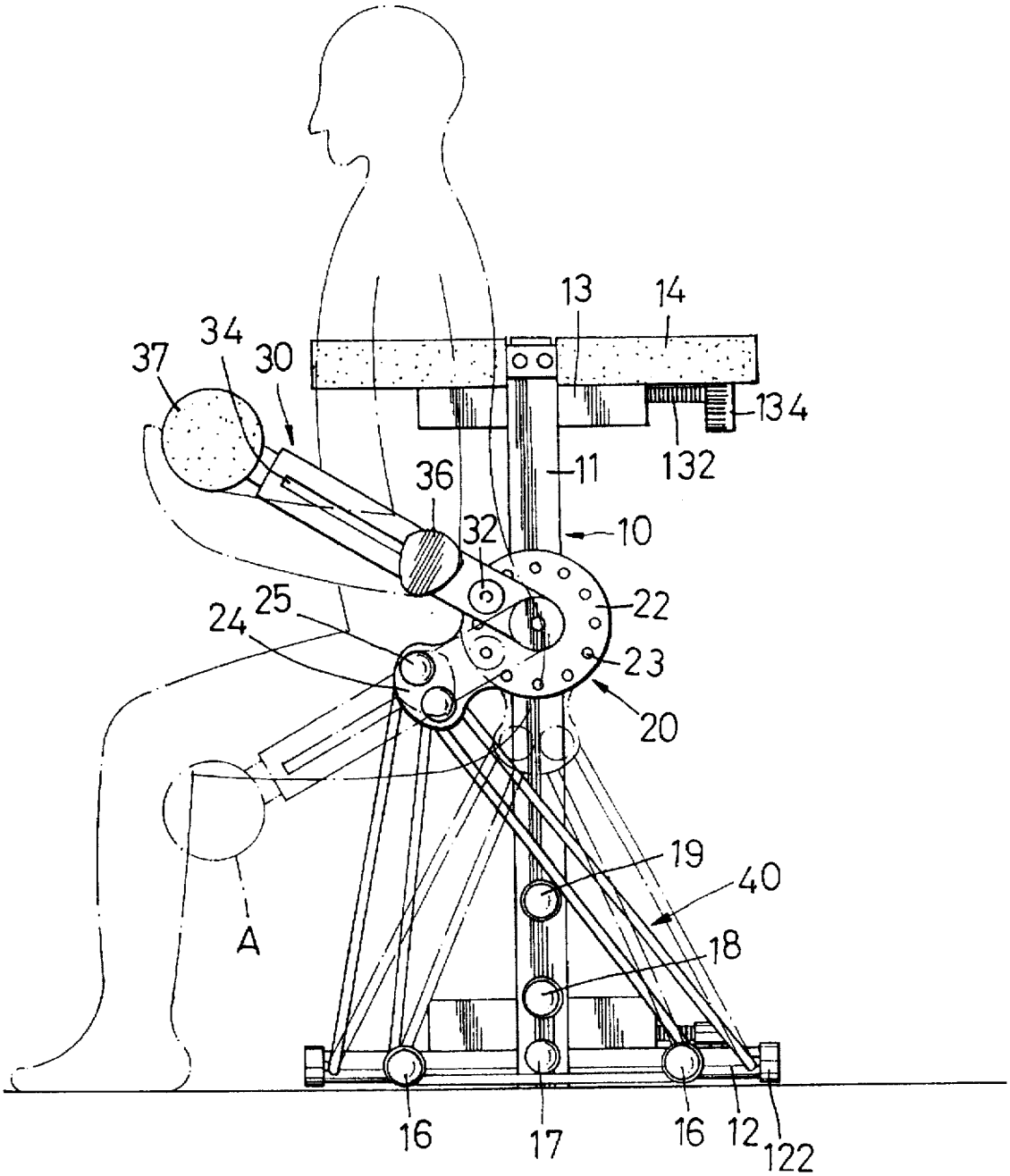
FIG. 6 is a schematic view illustrating how the exerciser is used to exercise the arms of the user in accordance with the present invention.
Figure 7:
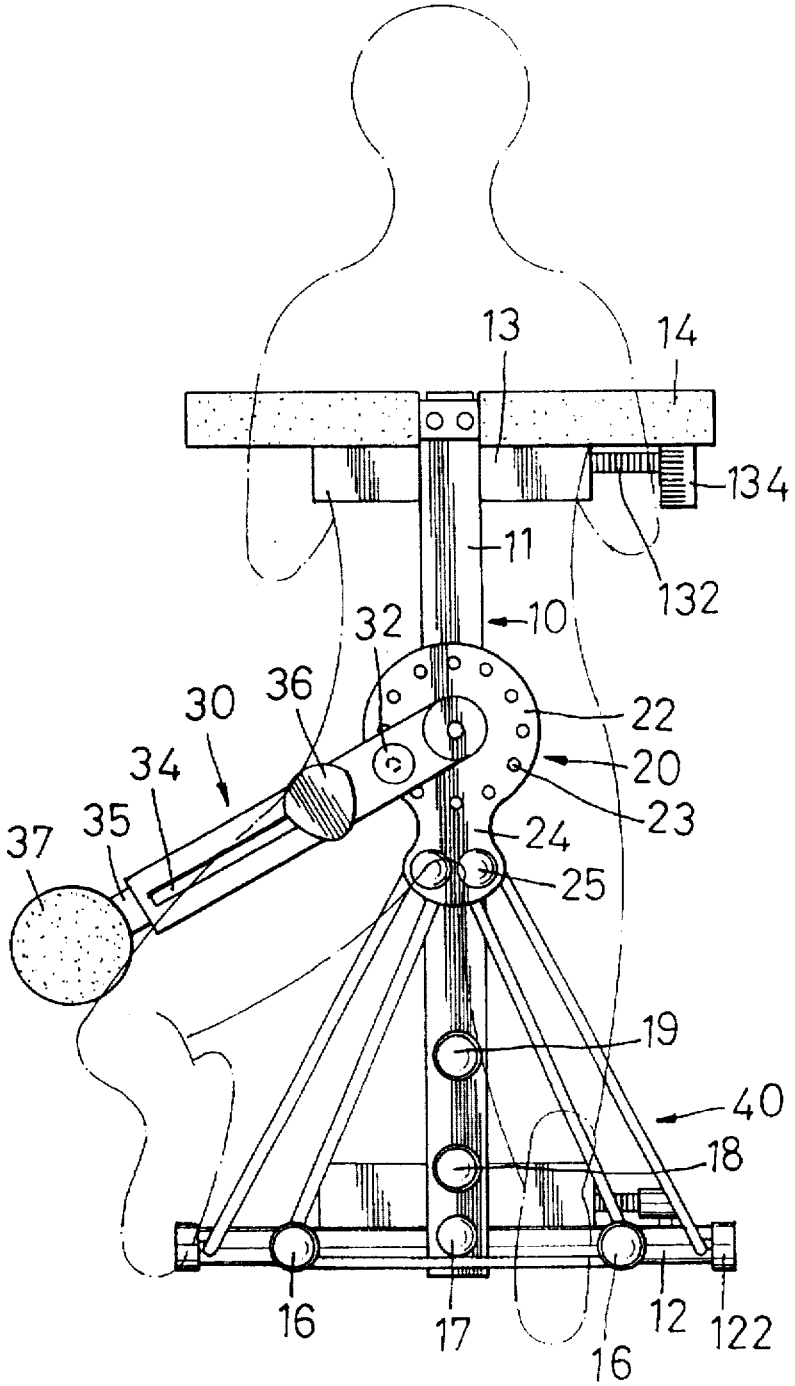
FIG. 7 is a schematic view illustrating how the exerciser is used to exercise the thighs of the user according to the present invention.

Referring to FIG. 6, when the user wants to exercise his/her arms, the driven rod 30 is positioned at a lower position which forms an angle of 30 to 45 degrees relative to the upright rod 11 at the left side of the upright rod 11, as shown by the phantom line (A). The user may then grasp the transverse bar 37 and push the same upwardly against the tension of the elastic cord 40. The user may kneel down and lift the transverse bar 37 which is located on the lower position in FIG. 6 by means of one of his/her thighs in order to exercise the same, as best illustrated in FIG. 7.

Figure 8:
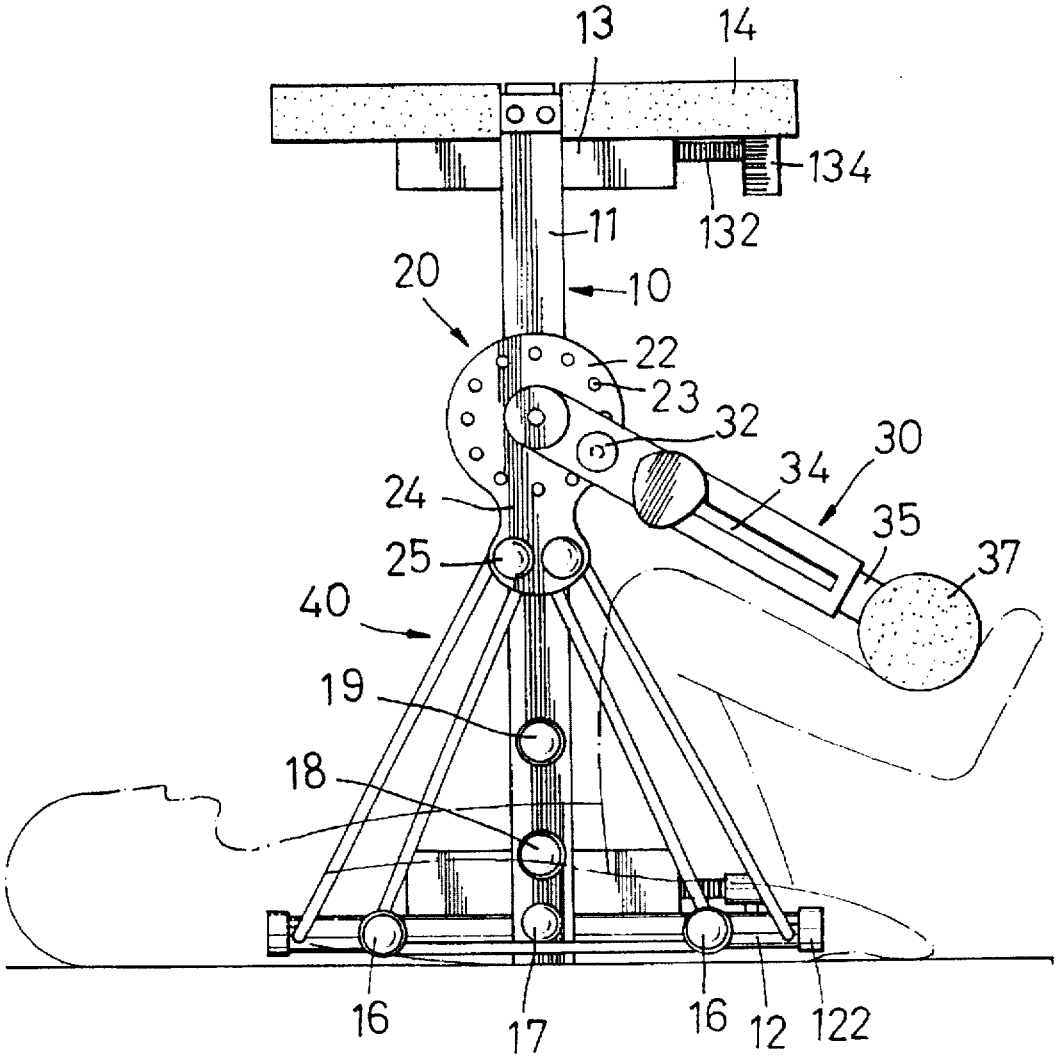
FIG. 8 is a schematic view illustrating how the exerciser is used to exercise the legs and the abdomen of the user according to the present invention.
Figure 9:
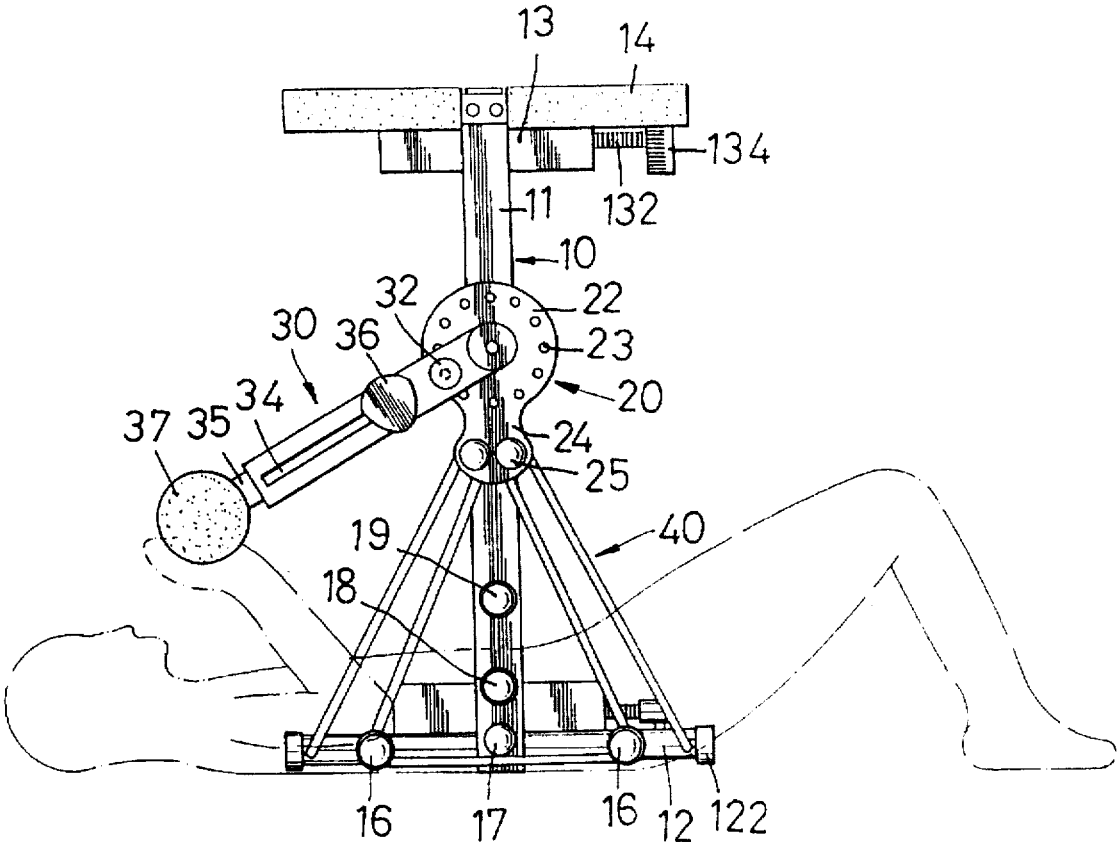
FIG. 9 is a schematic view illustrating how the exerciser is used for weight lifting purposes according to the present invention.

Referring to FIG. 8, the driven rod 30 is positioned at the right side of the upright rod 11 to form an angle of 45 degrees relative to the upright rod 11. The user may lie down on the floor or carpet and lift the transverse bar 37 by means of his/her legs in order to exercise the legs and the abdomen. Alternatively, the user may push the transverse bar 37 which is located on the lower position in FIG. 6 by means of his/her hands in order to perform weight lifting exercise, as shown in FIG. 9.

Figure 10:
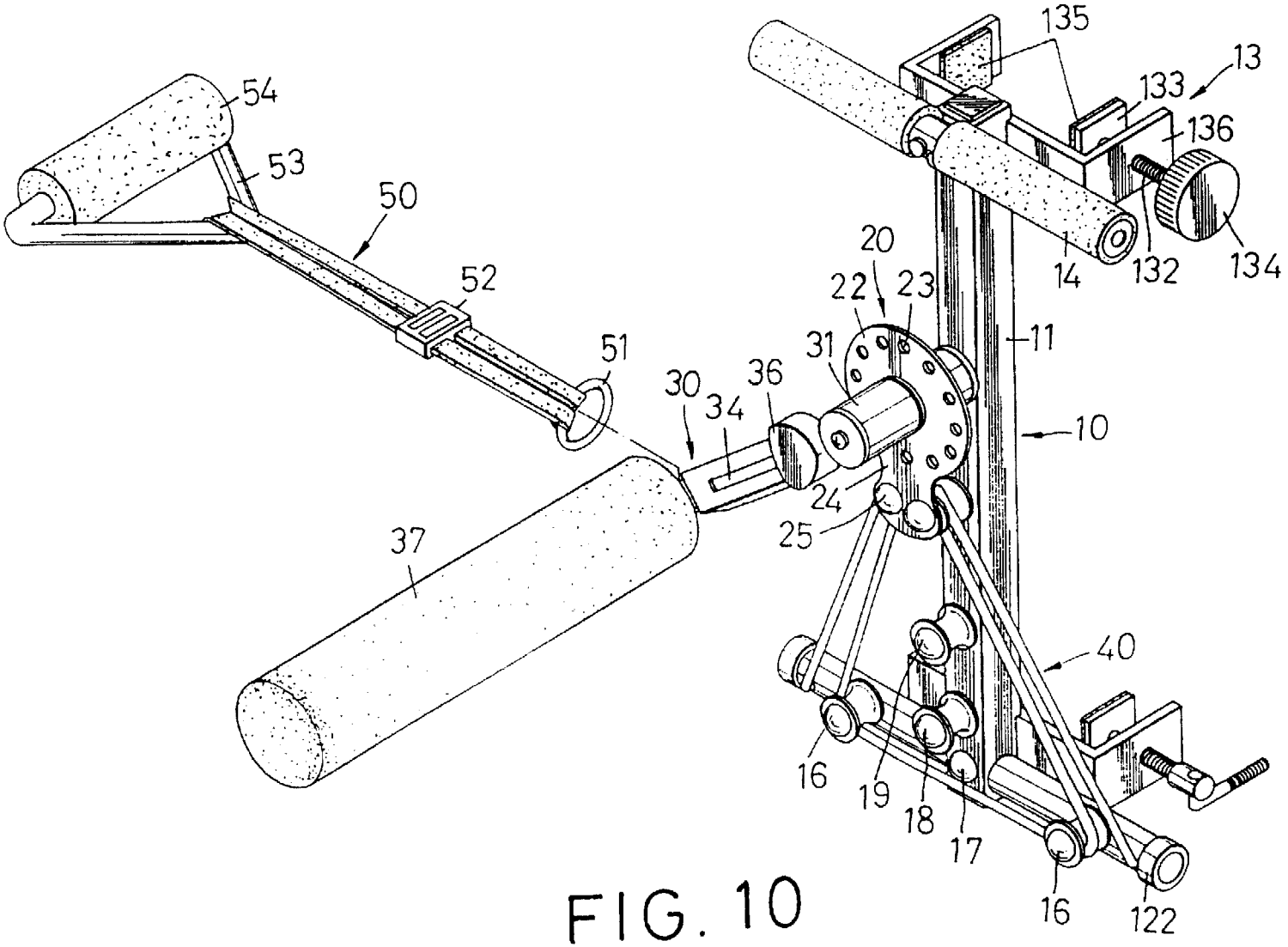
FIG. 10 is a partially exploded view of another preferred embodiment of an exerciser according to the present invention.

FIG. 10 illustrates another preferred embodiment of an exerciser according to the present invention. In this embodiment, a stretchable belt 50 is additionally mounted to the exerciser of the first embodiment. The stretchable belt 50 has a ring member 51 which is connected to a first end of the stretchable belt 50 for engaging the transverse bar 37, and a handle 53 with a foam rubber 54 which is connected to a second end of the stretchable belt 50. A length-adjustable member 52 is connected to the stretchable belt 50 for adjusting the length of the latter.

It is noted that the exerciser of the preferred embodiments can be employed conveniently to exercise different parts of the body. Thus, the object of the present invention is met.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangement.

I claim:

1. An exerciser comprising:

a base frame including an upright rod which has upper and lower ends and an intermediate portion, a transverse rod which has two end portions and an intermediate portion connected to said lower end of said upright rod, two U-shaped clamping members which are fastened respectively to said upper and lower ends of said upright rod, a handle bar which is connected transversely adjacent to said upper end of said upright rod, a pivot shaft which extends perpendicularly from said intermediate portion of said upright rod, and a plurality of adjusting pulleys which are mounted rotatably and lengthwise adjacent to said lower end of said upright rod, each of said end portions of said transverse rod having a pulley connected rotatably thereto;

a rotary plate having a circular portion with a central hole and an eccentric portion which extends radially from a periphery of said circular portion, said pivot shaft passing through said central hole of said rotary plate so that said rotary plate can rotate about said pivot shaft, said circular portion having a plurality of positioning holes spaced angularly near said periphery of said circular portion, said eccentric portion having a rear side face and left and right pulleys mounted rotatably to said rear side face of said eccentric portion;

a driven rod having an upper end which is connected rotatably to said pivot shaft, a positioning pin which extends slidably through said driven rod and which is extendible into one of said positioning holes in order to position said driven rod relative to said rotary plate at a selected angle, a lower end, a receiving bore which extends longitudinally from said lower end of said driven rod, an elongated groove which is formed in said driven rod and which is communicated with said receiving bore, an adjusting rod which is received slidably in said receiving bore and which has a lower end that extends out of said receiving bore, and a locking screw which passes through said elongated groove and which engages threadedly said adjusting rod in order to lock said adjusting rod relative to said driven rod and adjust a total length of said driven rod and said adjusting rod, said lower end of said adjusting rod having a transverse bar which is connected perpendicularly thereto; and an elastic cord having two ends which are connected respectively to said end portions of said transverse rod, said elastic cord passing over said right pulley of said rotary plate, passing under said pulleys of said transverse rod and passing over said left pulley of said rotary plate under tension;

whereby a resistive force is exerted onto said rotary plate by said elastic cord when said rotary plate is rotated about said pivot shaft.

2. The exerciser as claimed in claim 1, wherein each of said end portions of said transverse rod is hollow and has a longitudinal notch, each of said ends of said elastic cord having a knot which engages a respective one of said notches of said transverse rod, and a cap member connected thereto in order to prevent said ends of said elastic cord from disengaging said transverse rod.

3. The exerciser as claimed in claim 1, wherein each of said U-shaped clamping members has a base portion with an external face, and a recess which is formed in said external face of said base portion and which engages fittingly said upright rod.

4. The exerciser as claimed in claim 1, further comprising a stretchable belt, said stretchable belt having first and second ends, a ring member which is connected to said first end of said stretchable belt for engaging said transverse bar, a handle with a foam rubber which is connected to said second end of said stretchable belt, and a length-adjustable member connected to said stretchable belt for adjusting a length of said stretchable belt.

* * * * *